US007389073B2

(12) United States Patent
Kumar et al.

(10) Patent No.: US 7,389,073 B2
(45) Date of Patent: Jun. 17, 2008

(54) ELECTROSTATOGRAPHIC DEVELOPER UNIT HAVING MULTIPLE MAGNETIC BRUSH ROLLS HAVING DISSIMILAR COMPOSITIONS

(75) Inventors: Ajay Kumar, Fairport, NY (US); Keith Allan Nau, Webster, NY (US); David Antwone Reed, Rochester, NY (US); Hirotsugu Oba, Webster, NY (US)

(73) Assignee: Xerox Corporation, Stamford, CT (US)

( * ) Notice: Subject to any disclaimer, the term of this patent is extended or adjusted under 35 U.S.C. 154(b) by 122 days.

(21) Appl. No.: 11/391,837

(22) Filed: Mar. 29, 2006

(65) Prior Publication Data

US 2007/0231018 A1 Oct. 4, 2007

(51) Int. Cl.
*G03G 15/09* (2006.01)

(52) U.S. Cl. ..... 399/269; 399/276; 430/122.1

(58) Field of Classification Search ..... 399/269, 399/267, 276; 430/122.1
See application file for complete search history.

(56) References Cited

U.S. PATENT DOCUMENTS

| | | | | |
|---|---|---|---|---|
| 4,018,187 | A * | 4/1977 | Abbott et al. | 399/276 |
| 4,098,228 | A | 7/1978 | Ruckdeschel et al. | 399/269 |
| 4,282,827 | A * | 8/1981 | Andrews | 399/269 X |
| 4,308,821 | A * | 1/1982 | Matsumoto et al. | 399/276 X |
| 4,537,494 | A * | 8/1985 | Lubinsky et al. | 399/269 X |
| 4,537,495 | A | 8/1985 | Kopko | 399/138 |
| 4,811,046 | A | 3/1989 | May | 399/236 |
| 5,194,905 | A | 3/1993 | Brewington | 399/224 |
| 5,630,201 | A | 5/1997 | Suzuki et al. | 399/269 |
| 5,930,569 | A | 7/1999 | Roof, Jr. et al. | 399/269 |
| 6,269,235 | B1 | 7/2001 | Nishiyama | 399/267 |
| 6,292,645 | B1 * | 9/2001 | Yu | 399/269 X |
| 6,353,723 | B1 | 3/2002 | Hays et al. | 399/281 |
| 6,473,586 | B2 | 10/2002 | Noda et al. | 399/275 |
| 6,757,507 | B2 * | 6/2004 | Mochizuki et al. | 399/267 X |
| 6,965,746 | B2 | 11/2005 | Hays et al. | 399/270 |
| 2002/0181974 | A1 | 12/2002 | Sekiguchi | 399/269 |
| 2004/0105705 | A1 * | 6/2004 | Hirobe | 399/269 |
| 2006/0193660 | A1 * | 8/2006 | Imamura | 399/276 |
| 2007/0098457 | A1 * | 5/2007 | Chappell et al. | 399/269 |
| 2007/0098458 | A1 * | 5/2007 | Kumar et al. | 399/269 |

FOREIGN PATENT DOCUMENTS

| | | | |
|---|---|---|---|
| EP | 1333338 | A2 | 8/2003 |
| EP | 1708042 | A1 | 10/2006 |
| GB | 2088252 | A | 6/1982 |
| JP | 06-202480 | A * | 7/1994 |

* cited by examiner

*Primary Examiner*—Sophia S Chen
(74) *Attorney, Agent, or Firm*—Maginot, Moore & Beck

(57) ABSTRACT

A development station in an electrostatographic imaging machine supports longer operational life without undue variation in the mass of developer on roll parameter. The development station includes a developer housing, for retaining a quantity of developer having semi-conductive carrier particles and toner particles, a first magnetic roll having a stationary core with at least one magnet and a sleeve having longitudinal grooves that rotates about the stationary core of the first magnetic roll to transport developer to a photoreceptor, a second magnetic roll having a stationary core with at least one magnet and a sleeve having longitudinal grooves that rotates about the stationary core of the second magnetic roll to receive developer from the first magnetic roll and present the developer to the photoreceptor, the sleeve of the second magnetic roll being fabricated from a material that is softer than the sleeve of the first magnetic roll.

16 Claims, 4 Drawing Sheets

ELECTROSTATOGRAPHIC DEVELOPER UNIT HAVING MULTIPLE MAGNETIC BRUSH ROLLS HAVING DISSIMILAR COMPOSITIONS

CROSS-REFERENCE TO RELATED APPLICATIONS

Reference is made to commonly-assigned co-pending U.S. patent application Ser. No. 11/262,575, entitled "Xerographic Developer Unit Having Multiple Magnetic Bursh Rolls Rotating Against The Photoreceptor," which was filed on Oct. 31, 2005; U.S. patent application Ser. No. 11/262,577 entitled "Xerographic Developer Unit Having Multiple Magnetic Brush Rolls With A Grooved Surface," which was filed on Oct. 31, 2005; U.S. patent application Ser. No. 11/262,576 entitled "Xerographic Developer Unit Having Multiple Magnetic Brush Rolls Rotating With The Photoreceptor," which was filed on Oct. 31, 2005; U.S. patent application Ser. No. 11/263,370 entitled "Variable Pitch Auger To Improve Pickup Latitude In Developer Housing", which was filed on Oct. 31, 2005, and U.S. patent application Ser. No. 11/263,371 entitled "Developer Housing Design With Improved Sump Mass Variation Latitude," which was filed on Oct. 31, 2005, the disclosures of which are incorporated herein.

TECHNICAL FIELD

The present disclosure relates generally to an electrostatographic or xerographic printing machine, and more particularly concerns a development subsystem having multiple developer rolls that delivers semi-conductive developer to a photoreceptor.

BACKGROUND

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

One familiar type of development of an electrostatic image is called "two-component development." Two-component developer material largely comprises toner particles interspersed with carrier particles. The carrier particles may be attracted magnetically and the toner particles adhere to the carrier particles through triboelectric forces. This two-component developer can be conveyed, by means such as a "magnetic roll," to the electrostatic latent image, where toner particles become detached from the carrier particles and adhere to the electrostatic latent image.

In magnetic roll development systems, the carrier particles with the triboelectrically adhered toner particles are transported by the magnetic rolls through a development zone. The development zone is the area between the outside surface of a magnetic roll and the photoreceptor surface on which a latent image has been formed. Because the carrier particles are attracted to the magnetic roll, some of the toner particles are interposed between a carrier particle and the latent image on the photoreceptor. These toner particles are attracted to the latent image and transfer from the carrier particles to the latent image. The carrier particles are removed from the development zone as they continue to follow the rotating surface of the magnetic roll. The carrier particles then fall from the magnetic roll and return to the developer supply where they attract more toner particles and are reused in the development process. The carrier particles fall from the magnetic roll under the effects of gravity or are directed away from the roller surface by a magnetic field.

One type of carrier particle used in two-component developers is the semi-conductive carrier particle. Developers using this type of carrier particle are also capable of being used in magnetic roll systems that produce toner bearing substrates at speeds of up to approximately 200 pages per minute (ppm). Developers having semi-conductive carrier particles use a relatively thin layer of developer on the magnetic roll in the development zone. In these systems an AC electric waveform is applied to the magnetic roller to cause the developer to become electrically conductive during the development process. The electrically conductive developer increases the efficiency of development by preventing development field collapse due to countercharge left in the magnetic brush by the developed toner. A typical waveform applied to these systems is, for example, a square wave at a peak to peak amplitude of 1000 Volts and a frequency of 9 KHz. This waveform controls both the toner movement and the electric fields in the development zone. These systems may be run in a "with" mode, which means the magnetic roll surface runs in the same direction as the photoreceptor surface, or in an "against" mode, which means the magnetic roll surface runs in a direction that is the opposite direction in which the photoreceptor surface runs. The high surface speed at which these magnetic rolls are operated require high strength magnets to control the developer bed. These types of magnets are expensive. Additionally, high speeds also increase the wear on bearings in the developer housing.

Another issue in known magnetic roll systems used with developers having semi-conductive carrier particles is the difficulty in extending the development zone to increase the time in which toner development may occur. One method for increasing development zone length with other developers having insulated or conductive carrier particles is to use two magnetic rolls. The two rolls are placed close together with their centers aligned to form a line that is parallel to the photoreceptor. Because the developer layer for semi-conductive carrier particle developer is so thin, magnetic fields sufficiently strong enough to cause semi-conductive carrier particles to migrate in adequate quantities from one magnetic roll to the other magnetic roll also interfere with the transfer of toner from the carrier particles in the development zones. Consequently, construction of the magnetic rolls requires careful consideration of this interference. If two rolls are not able to be used to increase the development zone, then the radius of the magnetic roll may be increased to accommodate this goal. There is a limit, however, to the diameter of the magnetic roll. One limit is simply the area within the printing machine that is available for a development subsystem. Another limit is the size and strength of the magnets internal to the magnetic roll that are required to provide adequate magnetic field strengths and shapes at the surface of a larger magnetic roll.

To address the issues arising in development systems having two magnetic development rolls, a development station has been implemented that increases the time for developing the toner and provides an adequate supply of developer for good line detail, edges, and solids. The development system includes an upper magnetic developer roller and a lower magnetic developer roller. Both developer rollers have a stationary core with at least one magnet and a sleeve that rotates about the stationary core. A motor coupled to the two magnetic developer rolls drives the rotating sleeves of the magnetic developer rolls in a direction that is against the rotational direction of a photoreceptor to which the two magnetic rolls deliver toner. The two magnetic developer rolls carry semi-conductive carrier particles and toner particles through a development zone formed by the magnetic developer rolls. A trim blade is mounted proximate the upper magnetic developer roll to form a trim gap of approximately 0.5 to approximately 0.75 mm.

This development station architecture has resulted in improved development for electrostatographic imaging machines and increased the life of such machines to approximately 20 million developed images. The architecture described above uses stainless steel sleeves for both magnetic developer rolls. One issue arising from the use of stainless steel sleeves is the variation in the grooves formed in the stainless steel sleeves. In order to provide quality image development over the increased life of imaging machine, the stainless steel sleeves cannot be simply sand blasted as was formerly done, but instead grooves are required to be cut in their surfaces. The machining of these grooves in the stainless steel sleeves results in variation in these grooves. Groove variation causes the mass of developer on a roll to vary from machine to machine. The mass on developer on a roll parameter is sometimes denoted as MOR. Other material types do not appear to be available for construction of the two magnetic developer rolls as the longer life of the machine results in excessive wear in other materials, such as aluminum, that lead to degradation in image quality over the life of the machine.

The system and method discussed below address the issue of variation in MOR in development stations having two magnetic developer rolls with grooved surfaces.

SUMMARY

A development station in an electrostatographic imaging machine supports longer operational life without undue variation in the mass of developer on roll (MOR) parameter. The development station includes a developer housing, for retaining a quantity of developer having semi-conductive carrier particles and toner particles, a first magnetic roll having a stationary core with at least one magnet and a sleeve having longitudinal grooves that rotates about the stationary core of the first magnetic roll to transport developer to a photoreceptor, a second magnetic roll having a stationary core with at least one magnet and a sleeve having longitudinal grooves that rotates about the stationary core of the second magnetic roll to receive developer from the first magnetic roll and present the developer to the photoreceptor, the sleeve of the second magnetic roll being fabricated from a material that is softer than the sleeve of the first magnetic roll.

The development station may be made with a method that comprises mounting a first sleeve having longitudinal grooves that was made from a first material about a first stationary core having at least one magnet so that the first sleeve rotates about the first stationary core; and mounting a second sleeve having longitudinal grooves that was made from a second material that is softer than the first material about a second stationary core having at least one magnet so that the second sleeve rotates about the second stationary core. A development station made having the first and second magnetic rolls being made from materials of different hardness supports longer operational life without undue variation in the mass of developer on roll (MOR) parameter.

DETAILED DESCRIPTION

Figure 1:
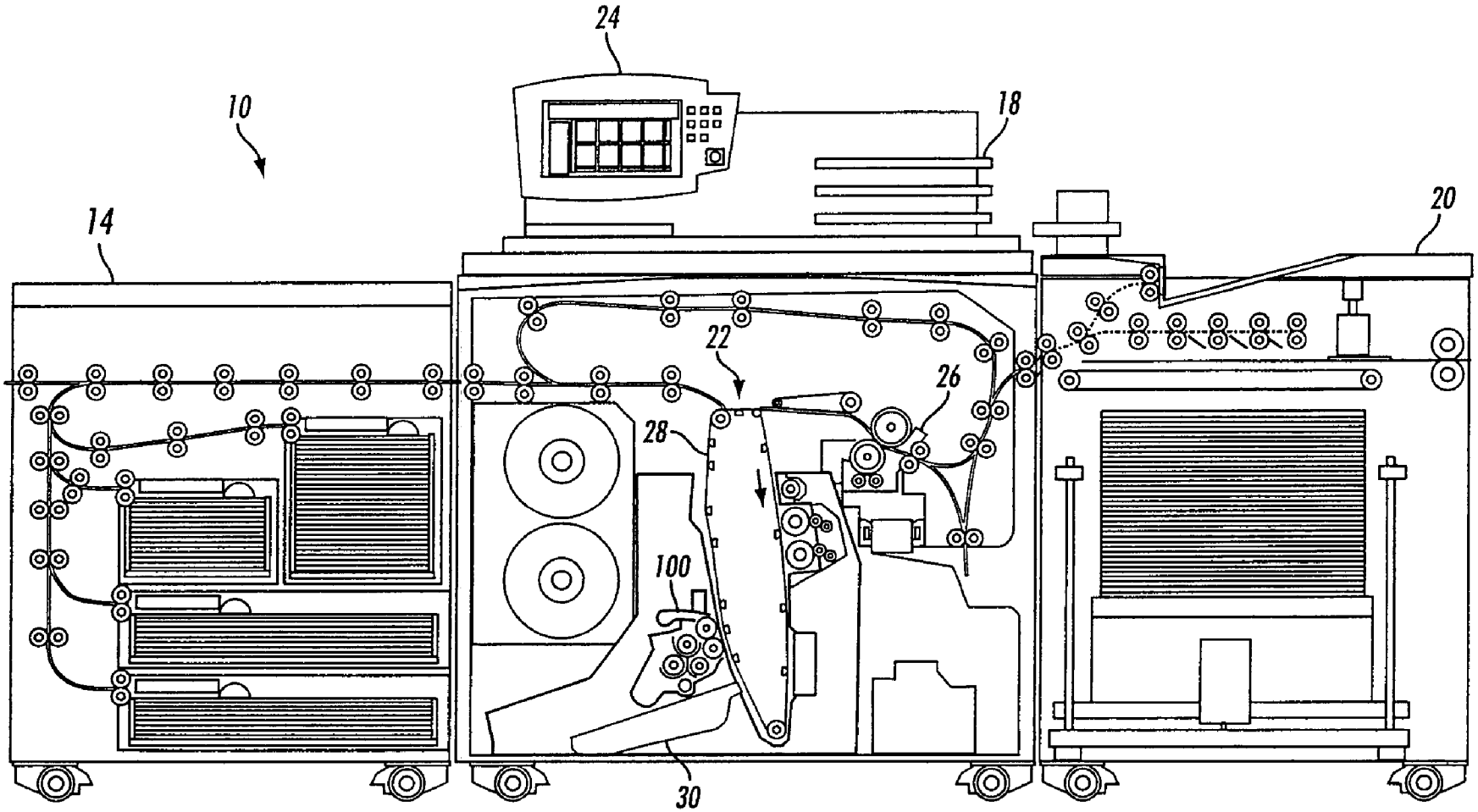
FIG. 1 is an elevational view of an electrostatographic imaging machine incorporating a semi-conductive magnetic brush development (SCMB) system having two magnetic rolls with sleeves made from different materials.

FIG. 1 is an elevational view of an electrostatographic imaging machine 10, such as a printer or copier, having a development subsystem that uses two magnetic rolls with sleeves made from different materials for developing toner particles that are carried on semi-conductive carrier particles. The machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the printing machine 10 or received over an electrical communication link. The page images are used to generate bit data that are provided to a raster output scanner (ROS) 30 for forming a latent image on the photoreceptor 28. Photoreceptor 28 continuously travels the circuit depicted in the figure in the direction indicated by the arrow. The development station 100 develops toner on the photoreceptor 28. At the transfer station 22, the toner conforming to the latent image is transferred to the substrate by electric fields generated by the transfer station. The substrate bearing the toner image travels to the fuser station 26 where the toner image is fixed to the substrate. The substrate is then carried to the output unit 20. This description is provided to generally describe the environment in which a double magnetic roll development system for developer having semi-conductive carrier particles may be used and is not intended to limit the use of such a development subsystem to this particular printing machine environment.

Figure 2:
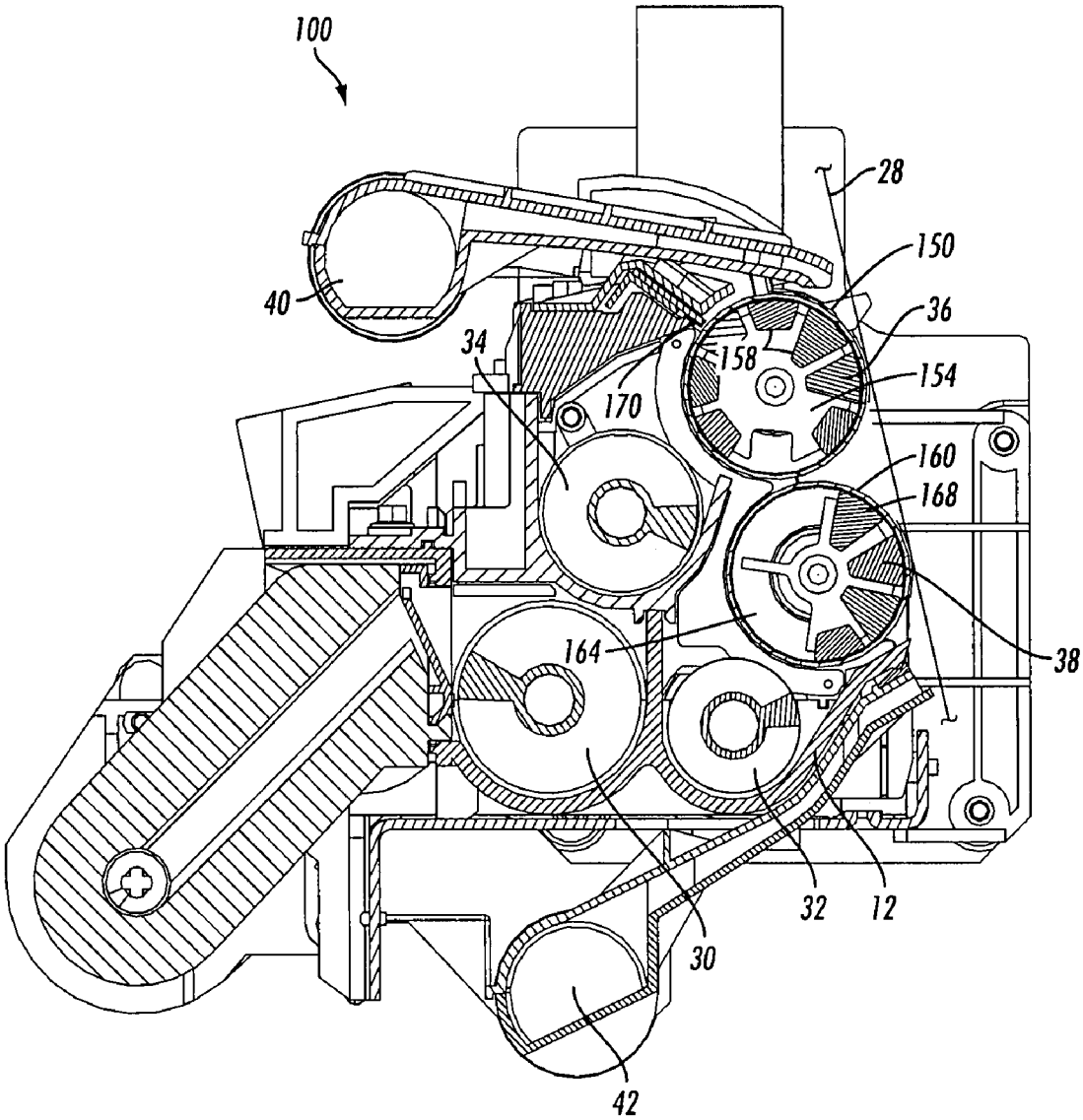
FIG. 2 is a sectional view of a SCMB developer unit having two magnetic rolls with sleeves made from different materials.

The overall function of developer station 100, which is shown in FIG. 2, is to apply marking material, such as toner, onto suitably-charged areas forming a latent image on an image receptor such as the photoreceptor 28, in a manner generally known in the art. The developer station 100, however, provides a longer development zone with less variation in MOR over the operational life of the machine 10 while maintaining an adequate supply of developer having semi-conductive carrier particles than development stations previously known. In various types of printers, multiple developer stations 100 of this construction may be used. For example, one such station may be used for each primary color or other purpose.

Among the elements of the developer station 100, which is shown in FIG. 2, are a housing 12, which functions generally to hold a supply of developer material having semi-conductive carrier particles, as well as augers, such as 30, 32, 34, which variously mix and convey the developer material to the magnetic rolls 36, 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12. The augers 30, 32, and 34 are configured and cooperate in a manner described in co-pending applications entitled "Variable Pitch Auger To Improve Pickup Latitude In Developer Housing," which was filed on Oct. 31, 2005 and assigned Ser. No. 11/263,370, and "Developer Housing Design With Improved Sump Mass Variation Latitude," which was also filed on Oct. 31, 2005 and assigned Ser. No. 11/263,371, both of which are hereby expressly incorporated herein in their entireties by reference and are commonly assigned to the assignee of this patent application.

Figure 3:
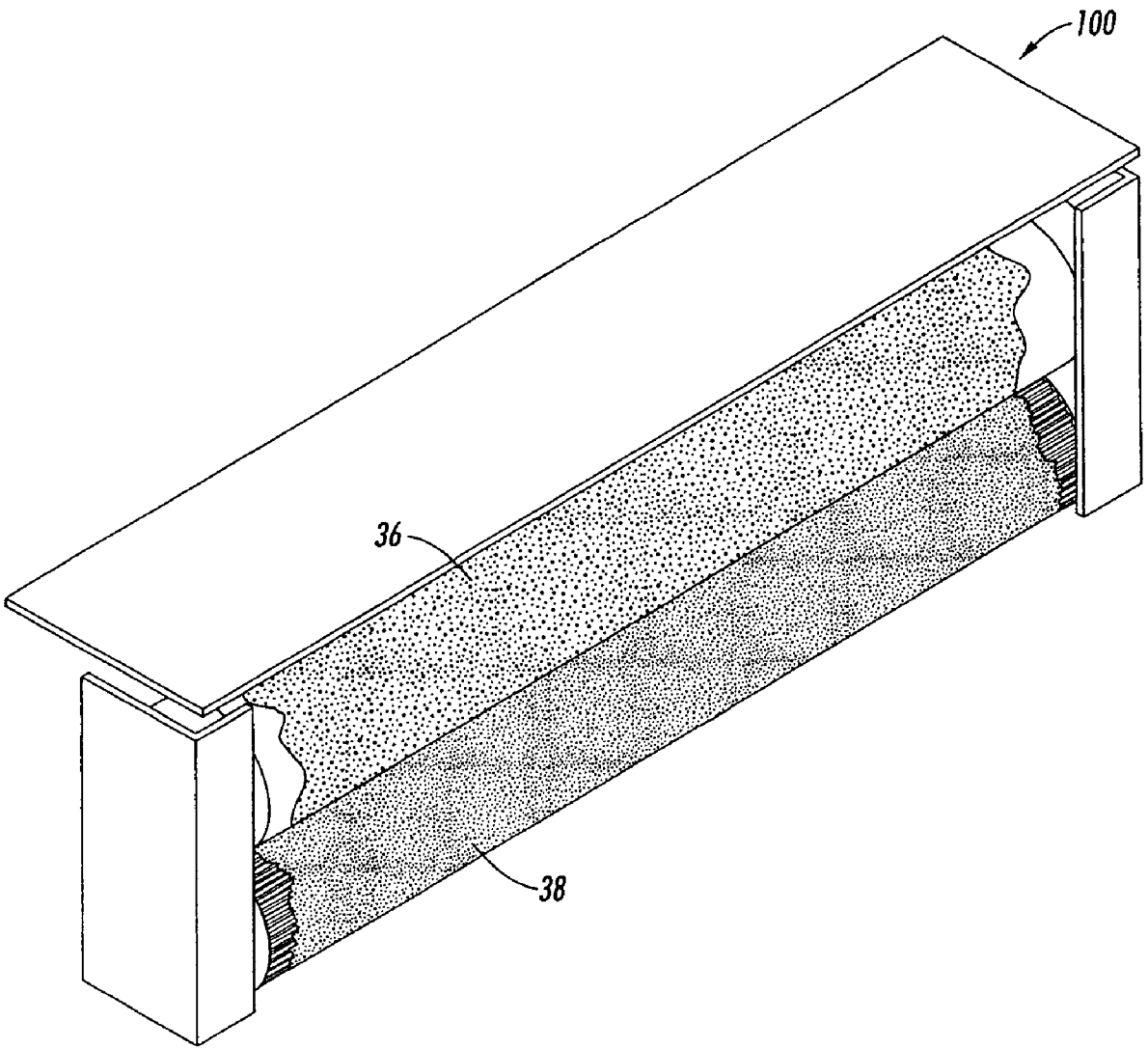
FIG. 3 is a perspective view of a SCMB developer unit having two magnetic rolls made from different materials and having longitudinal grooves of different dimensions.

FIG. 3 is a perspective view of a portion of developer station 100. As can be seen in this embodiment, the upper magnetic roll 36 and the lower magnetic roll 38 form a development zone that is approximately as long as the two diameters of the magnetic rolls 36 and 38. A motor, not shown, is coupled to the rolls 36 and 38 to cause rotation of the various augers, magnetic rolls, and any other rotatable members within the developer station 100 at various relative velocities. There may be provided any number of such motors. The magnetic rolls 36 and 38 may be rotated in a direction that is opposite to the direction in which the photoreceptor moves past the developer station 100. That is, the two magnetic rolls are operated in the against mode for development of toner, although the magnetic rolls may also be operated in the with mode as well. In one embodiment of the developer station 100, the motor rotates the magnetic rolls at a speed in the range of about 1 to about 1.5 times the rotational speed of the photoreceptor 28. This rotational speed is lower than the rotational speed of magnetic rolls in developer systems that rotate in the same direction as the photoreceptor. That is, the magnetic rolls operated in the against mode may be rotated at lower speeds than magnetic rolls operated in the with mode. These slower speeds increase the life of the magnetic rolls over the life of magnetic rolls that are operated in the with mode to develop toner carried on semi-conductive carrier particles.

As may be observed from FIG. 2, the upper magnetic roll 36 includes a sleeve 150 that is mounted about a stationary core 154 that has at least one magnet 158. Likewise, the lower magnetic roll 38 includes a sleeve 160 that is mounted about a stationary core 164 that has at least one magnet 168. Longitudinal grooves are provided in the surface of the sleeves to impede slippage of developer on the rotating sleeve. A trim blade 170 is mounted in proximity to upper magnetic roll 36 to remove excess developer from the roll 36 before it is carried into the development zone formed by rolls 36 and 38. The trimming operation generates significant stress on the upper roll 36 over the life of the machine. Over the operational life of approximately 20 million images, the longitudinal grooves in the roll 36, and to some degree in roll 38 as well, wear, which causes image quality to degrade unless the rolls are made from a material that is wear resistant.

In previously known development stations having two magnetic rolls arranged in the vertical manner as shown in FIG. 2, the sleeves 150 and 160 were made from stainless steel tubes. Although this material is wear resistant over this operational life, the machining of the grooves in the stainless tube results in dimensional variations for the grooves as well as roughness variation in the tube surfaces. These dimensional and roughness variations cause mass of developer on roll (MOR) at operational life commencement to vary between machines. The initial value for MOR affects the development station operational control and machine image quality.

Figure 4:
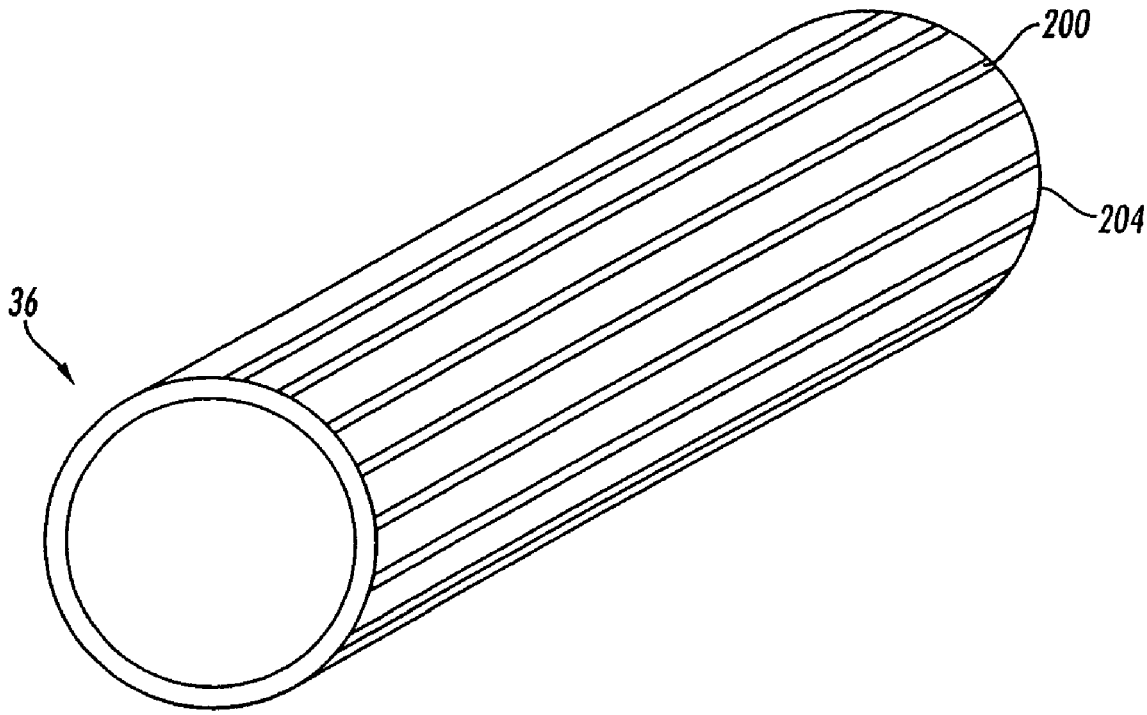
FIG. 4 is a perspective view of an anodized aluminum sleeve that is mounted about a stationary core to form the upper magnetic roll in FIGS. 2 and 3.

In an embodiment that addresses the MOR variation at the beginning of an imaging machine's operational life, the upper magnetic roll has a sleeve that is anodized aluminum that has been extruded with the grooves formed in the surface of the sleeve. An example of such a sleeve is shown in FIG. 4. The sleeve 204 has longitudinal grooves 200 in its surface. Extrusion of the sleeves enables the surface of the sleeves to be smoother than the surface of machined stainless steel or aluminum tubes. Because the anodized aluminum is harder than stainless steel, the sleeve better endures the stress to which the upper magnetic roll is subjected over its operational life. Consequently, the grooves retain their dimensions over the life of the machine and MOR is not significantly altered.

The lower magnetic roll has a sleeve that looks very similar to the sleeve shown in FIG. 4, but it is made of stainless steel or non-anodized aluminum. The grooves in the lower magnetic roll sleeve are machined into the sleeve in a known manner. The use of a softer material in the lower magnetic roll sleeve does not jeopardize the integrity of the grooves because the stress on the lower magnetic roll is less than the stress on the upper magnetic roll. One reason for this reduced stress is the absence of a trimming operation at the lower magnetic roll.

The different materials used for the upper and lower sleeves enable the dimensions of the grooves to differ as well. In the sleeve shown in FIG. 4, the anodized aluminum sleeve has grooves with a depth of approximately 60 to approximately 70 microns, sides having a pitch length of approximately 0.6 mm to approximately 0.7 mm, and sides that are angled at approximately 90°±10°. The longitudinal grooves in the upper magnetic roll have finer dimensions than those of the lower magnetic sleeve. The sides of a groove in the lower magnetic roll are oriented at an angle of approximately 90°±10° and pitched to be a length of about 1.2 to about 1.4 mm. The depth of a groove in a lower magnetic roll may be approximately 90 to 100 microns. The grooves in both sleeves may be formed in a U or V shape, although other shapes may be used.

The U or V-shaped grooves in the sleeves may be formed in one of two manners. In one construction, the sides of the U or the V-shaped groove may have the same pitch, but the U-shaped groove is deeper than the V-shaped groove. In the other construction, the U and V-shaped groove may have the same depth, but the U-shaped groove has sides with a pitch that is shallower than the sides of the V-shaped groove.

The finer dimensions of the grooves in the upper magnetic roll provide a denser packing fraction than the grooves in the lower magnetic roll. Additionally, the smaller dimensions in the grooves of the upper magnetic roll are subject to less variation in their formation than the larger dimensions of the grooves in the lower magnetic roll. Moreover, the roughness of the surface between the grooves in the upper magnetic roll sleeve has less variation than the surface roughness of the lower magnetic roll sleeve. The variation in the lower magnetic roll sleeve arises from the machining to which the sleeve is subjected to form the longitudinal grooves. Consequently, the provision of shallower grooves and narrower pitch in the grooves of the upper magnetic roll sleeve formed from anodized aluminum decreases the likelihood of variation in MOR at the start of machine operation and over the operational life of a machine than machines implementing the two roller SCMB architecture with the rotating sleeves formed from either stainless steel or non-anodized aluminum.

Although the various embodiments described above have been discussed with regard to an arrangement in which the developer is distributed from an upper magnetic roll to a lower magnetic roll, the reverse may also be used in another embodiment. In such an embodiment, the developer having semi-conductive carrier particles is picked up by the lower magnetic roll and then transferred from the lower magnetic roll to the upper magnetic roll. At the upper magnetic roll, the semi-conductive carrier particles are removed by gravity or the magnetic field generated by one or more magnets in the upper magnetic roll or a combination of gravity and magnetic fields. The removed carrier particles are returned to the developer supply. In such an embodiment, the lower magnetic roll sleeve is made from anodized aluminum with grooves having finer dimensions than the grooves in the stainless steel or non-anodized aluminum sleeves of the upper magnetic roll sleeve.

The development station described above may be made by mounting a first sleeve having longitudinal grooves that was made from a first material about a first stationary core having at least one magnet so that the first sleeve rotates about the first stationary core. In one embodiment, the sleeve of the first magnetic roll is made from anodized aluminum. A second sleeve having longitudinal grooves is mounted about a second stationary core having at least one magnet so that the second sleeve rotates about the second stationary core. The material from which the second sleeve was made is softer than the material from which the first sleeve was made. In one embodiment, the longitudinal grooves in the second sleeve are deeper and have a greater pitch that the longitudinal grooves in the first sleeve. A development station so constructed supports longer operational life without undue variation in the mass of developer on roll (MOR) parameter.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A development station for an electrostatogranhic printing machine comprising:

a developer housing, for retaining a quantity of developer having semi-conductive carrier particles and toner particles;

a first magnetic roll having a stationary core with at least one magnet and a sleeve that is fabricated from anodized aluminum and having longitudinal grooves, the sleeve rotatably mounted about the stationary core of the first magnetic roll to transport developer to a photoreceptor;

a second magnetic roll having a stationary core with at least one magnet and a sleeve having longitudinal grooves that rotates about the stationary core of the second magnetic roll to receive developer from the first magnetic roll and present the developer to the photoreceptor, the sleeve of the second magnetic roll being fabricated from a material that is softer than the sleeve of the first magnetic roll.

2. The development station of claim 1, the sleeve of the second magnetic roll being fabricated from non-anodized aluminum.

3. The development station of claim 1, the sleeve of the second magnetic roll being fabricated from stainless steel.

4. The development station of claim 1, the longitudinal grooves in the sleeve of the first magnetic roll having a shallower depth and a narrower pitch than the longitudinal grooves in the sleeve of the second magnetic roll.

5. The development station of claim 4, the longitudinal grooves in the anodized aluminum sleeve having a depth of approximately 60 to approximately 70 microns.

6. The development station of claim 5, the longitudinal grooves in the anodized aluminum sleeve having sides that are angled at approximately 90°±10° and the longitudinal grooves in the anodized aluminum sleeve being pitched so the grooves have a side of approximately 0.6 mm to approximately 0.7 mm in length.

7. The development station of claim 6, the longitudinal grooves in the sleeve of the second magnetic roll having a depth of approximately 90 microns to approximately 100 microns.

8. The development station of claim 7, the longitudinal grooves in the sleeve of the second magnetic roll having sides that are angled at approximately 90°±10°.

9. The development station of claim 8, the longitudinal grooves in the sleeve of the second magnetic roll being pitched to be a length of approximately 1.2 mm to approximately 1.4 mm.

10. A method for making a development station for delivering developer having semi-conductive carrier particles to a photoreceptor in an electrostatographic imaging machine, comprising:

mounting an anodized aluminum sleeve having longitudinal grooves about a first stationary core having at least one magnet so that the anodized aluminum sleeve rotates about the first stationary core;

mounting a second sleeve having longitudinal grooves that was made from a material that is softer than the anodized aluminum about a second stationary core having at least one magnet so that the second sleeve rotates about the second stationary core; and positioning the anodized aluminum sleeve and the first stationary core above the second sleeve and the second stationary core.

11. The method of claim 10, the mounting of the second sleeve about the second stationary core further comprises:

mounting a non-anodized aluminum sleeve about the second stationary core.

12. The method of claim 10, the mounting of the second sleeve about the second stationary core further comprises:

mounting a stainless steel sleeve about the second stationary core.

13. An electrostatographic printing machine comprising:

a photoreceptor;

a raster output scanner (ROS) that generates a latent image on a portion of the photoreceptor as it moves past the ROS;

a development subsystem for developing toner on the latent image;

a transfer station for transferring the developed toner to a substrate;

a fusing station for fixing the transferred toner to the substrate; the development station further comprising:

a developer housing, for retaining a quantity of developer having semiconductive carrier particles and toner particles;

a first magnetic roll having a stationary core with at least one magnet and a sleeve made from anodized aluminum with longitudinal grooves in its surface that rotates about the stationary core of the first magnetic roll; and a second magnetic roll having a stationary core with at least one magnet and a sleeve with longitudinal grooves in its surface that rotates about the stationary core of the second magnetic roll, the sleeve that rotates about the stationary core of the second magnetic roll being made from a material that is softer than the sleeve that rotates about the stationary core of the first magnetic roll.

14. The machine of claim 13 wherein the sleeve that rotates about the stationary core of the second magnetic roll is made from stainless steel.

15. The machine of claim 13 wherein the sleeve that rotates about the stationary core of the second magnetic roll is made from non-anodized aluminum.

16. The machine of claim 13 wherein the longitudinal grooves in the sleeve that rotates about the stationary core of the first magnetic roll have a depth of approximately 60 microns to approximately 70 microns; and the longitudinal grooves in the sleeve that rotates about the stationary core of the second magnetic roll have a depth of approximately 90 microns to approximately 100 microns.

* * * * *